US011273418B2

(12) United States Patent
Hernan Blanco

(10) Patent No.: US 11,273,418 B2
(45) Date of Patent: Mar. 15, 2022

(54) MIXING RING FOR DISSOLVING A PORTION OF SOLUTE IN A PORTION OF SOLVENT, SYSTEM AND METHOD FOR DISSOLVING A PORTION OF SOLUTE IN A PORTION OF SOLVENT

(71) Applicant: CYLZER S.A., Montevideo (UY)

(72) Inventor: Javier Hernan Blanco, Buenos Aires (AR)

(73) Assignee: CYLZER S.A.

( * ) Notice: Subject to any disclaimer, the term of this patent is extended or adjusted under 35 U.S.C. 154(b) by 0 days.

(21) Appl. No.: 15/763,106

(22) PCT Filed: Sep. 2, 2016

(86) PCT No.: PCT/BR2016/050218
§ 371 (c)(1),
(2) Date: Mar. 24, 2018

(87) PCT Pub. No.: WO2017/049375
PCT Pub. Date: Mar. 30, 2017

(65) Prior Publication Data

US 2018/0280895 A1 Oct. 4, 2018

(30) Foreign Application Priority Data

Sep. 25, 2015 (BR) ..... BR102015024699-4

(51) Int. Cl.
*B01F 5/04* (2006.01)
*B01F 1/00* (2006.01)
(Continued)

(52) U.S. Cl.
CPC ..... *B01F 1/0022* (2013.01); *B01F 1/0038* (2013.01); *B01F 3/088* (2013.01);
(Continued)

(58) Field of Classification Search
CPC ..... B01F 5/0415
(Continued)

(56) References Cited

U.S. PATENT DOCUMENTS 1,626,487 A * 4/1927 Warren ..... B01F 5/0405 366/163.2
1,678,225 A 7/1928 Kincade
(Continued)

FOREIGN PATENT DOCUMENTS

JP 2001-000849 1/2001
JP 2001-200800 7/2001

OTHER PUBLICATIONS

International Search Report dated Feb. 24, 2017 for International application No. PCT/BR2016/050218.
(Continued)

*Primary Examiner* — David L Sorkin
(74) *Attorney, Agent, or Firm* — Fay Sharpe LLP

(57) ABSTRACT

A mixing ring (1) for dissolving a portion of solute in a portion of solvent. The mixing ring (1) includes a solvent input path (2) and a solute input path (3) fluidly associated to a mixing path (4). The solvent input path (2) is configured to receive a portion of solvent and the solute input path (3) is configured to receive a portion of solute. The mixing ring (1) is structurally configured to lead the portion of solvent and the portion of solute to the mixing path (4), and the mixing ring (1) further includes a diffuser (5) mostly placed in an internal area of the mixing path (4). The diffuser (5) is configured to lead the portion of solvent towards the portion of solute. A system and method for dissolving a portion of solute in a portion of solvent is also provided.

37 Claims, 11 Drawing Sheets

(51) Int. Cl.
*B01F 5/06* (2006.01)
*B01F 3/08* (2006.01)
*B01F 15/04* (2006.01)

(52) U.S. Cl.
CPC ..... *B01F 5/043* (2013.01); *B01F 5/0415* (2013.01); *B01F 5/0486* (2013.01); *B01F 5/061* (2013.01); *B01F 5/0606* (2013.01); *B01F 15/0408* (2013.01)

(58) Field of Classification Search
USPC ..... 366/163.2
See application file for complete search history.

(56) References Cited

U.S. PATENT DOCUMENTS

| | | | | |
|---|---|---|---|---|
| 7,926,502 | B1 | 4/2011 | Lott | |
| 2004/0052155 | A1* | 3/2004 | Fabries | B01F 15/00357 366/163.2 |
| 2005/0077636 | A1* | 4/2005 | Bortkevitch | B01F 5/0428 261/76 |
| 2009/0178812 | A1 | 7/2009 | Solomon et al. | |
| 2010/0233769 | A1 | 9/2010 | Heathcote et al. | |
| 2013/0037973 | A1 | 2/2013 | Lavaque | |

OTHER PUBLICATIONS

Written Opinion dated Feb. 24, 2017 for International application No. PCT/BR2016/050218.

* cited by examiner

MIXING RING FOR DISSOLVING A PORTION OF SOLUTE IN A PORTION OF SOLVENT, SYSTEM AND METHOD FOR DISSOLVING A PORTION OF SOLUTE IN A PORTION OF SOLVENT

Present invention refers to a system, method and to a mixing ring for dissolving a portion of solute in a portion of solvent. Specifically, to a system, method and mixing ring configured to increase the efficiency of the mixing between the solute and solvent.

PRIOR ART DESCRIPTION

The prior art systems and methods for dissolving a portion of solute in a portion of solvent have some weaknesses (problems) in keeping the mixing ratio constant during the process.

In such systems, the solute dose (amount of solute in the solution) is 100% dependent from the measurement of the solute flow rate, such measurement being made according to a determined loop control of the system.

Basically, in the prior art systems, the solvent flow rate is kept constant at a determined value and, according to the determined solvent flow rate and the desired mixing ratio, the system adds a fixed syrup flow rate.

By loop control, it is meant the mechanisms and controls that acts in a determined process, preferably using a PLC (Programmable Logic Controller), to manage some variables of the process. For example, in a loop control, determined times are established in which the PLC should control a determined variable.

Specifically in a system and method for dissolving a portion of solute in a portion of solvent, a determined time could be the measurement time of the solvent flow rate, the measurement time of the solute flow rate and further the time for the PLC to determine which action should be taken.

As the PLC is further responsible for determine how to manage the solute dose, it should send a signal to a determined valve or pump which also will take a determined time to receive and interpret such signal and then increase or decrease the solute flow rate of the system.

The loop control is continually repeated during the process, wherein the determined times mentioned above have direct impact in the mixing ratio of solute and solvent, since the signal received by the valve or pump will not result in an instantaneous action, as it takes some time to such signal to be interpreted.

Consequently, a simple error in the loop control and in their mechanisms will directly impact in the total syrup dose that is, in the mixing ratio of solute and solvent.

In the proposed system, method and mixing ring for dissolving a portion of solute in a portion of solvent, the solute flow rate is automatically dragged by the solvent flow rate that flows in the system, and specifically in the mixing ring due to its structural configuration.

Consequently, and considering the actuation of the loop control, the system will not sense the times which the PLC sends a control signal to a determined valve, then such signal is received and interpreted and finally the valve is controlled.

In the proposed system, method and mixing ring, the actuation is in real time, as, variations in the water (solvent) flow rate automatically manages (controls) the syrup flow rate. In other words, and as mentioned before, the solute is dragged by the solvent due the structural configuration of the system and specially the mixing ring.

In present application the loop control will only be affected according to the opening/closing (management) of a solute modulating valve that will determine the required mixing ratio. Being the mixing process stable, it will be just necessary to manage the solute modulating valve in relation to the difference between the requested (required) mixing ratio and the real mixing ratio.

As the proposed mixing ring, system and method automatically conserves the proportionality of the final solution (solute/solvent) the necessity of correction in the solute flow rate is reduced.

Objectives

It is an objective of the present invention to provide a mixing ring structurally configured to dissolve a portion of solute in a portion of solvent, wherein the portion of solvent is perpendicularly lead towards the portion of solute.

A further objective of the present invention is to provide a mixing ring, a system and method for dissolve a portion of solute in a portion of solvent able to process any kind of solute with a viscosity inferior or equal to 170 cPs and any kind of solvent with a viscosity equal or inferior to 80 cPs.

An additional objective of the present invention is to provide a mixing ring, system and method for dissolve a portion of solute in a portion of solvent configured to reduce the necessity of actuation in the solute flow rate that enters the mixing ring.

A further objective is to provide a mixing ring, system and method configured to automatically manage variations in the solute flow rate due to variations in the solvent flow rate.

An additional objective is to provide a method for dissolve a portion of solute in a portion of solvent capable of control the real mixing ratio by managing just one between the solvent modulating valve or the solute modulating valve.

An additional objective is to provide a mixing ring and a mixing method able to be used in large scale systems, like in the beverage industry, and further able to be used in small scale systems, like in beverage machines of fast food restaurants.

The objective of the present invention is also to provide a mixing ring, system and method for dissolve a portion of solute in a portion of solvent able to be used in many application fields, as the beverage, chemical, pharmaceutical industries and further in the hospital sector.

BRIEF DESCRIPTION OF THE INVENTION

It is proposed a mixing ring for dissolve a portion of solute in a portion of solvent, the mixing ring comprising: a solvent input path and a solute input path fluidly associated to a mixing path wherein, the solvent input path is configured to receive a portion of solvent and the solute input path is configured to receive a portion of solute.

The mixing ring is structurally configured to lead the portion of solvent and the portion of solute to the mixing path, and the mixing ring further comprises a diffuser mostly placed in an internal area of the mixing path, the diffuser is configured to lead the portion of solvent towards the portion of solute.

The invention further purposes a system for dissolve a portion of solute in a portion of solvent, wherein the system comprises a solvent discharge duct configured to lead the portion of solvent from a solvent tank to a mixing ring, wherein a first end of the solvent discharge duct is associated to an bottom portion of the solvent tank, the solvent discharge duct comprising a solvent duct diameter that is equal to a first diameter of the mixing ring.

The system further comprises a solute discharge duct configured to lead the portion of solute from a solute tank to the mixing ring, wherein a first end of the solute discharge duct is associated to a bottom portion of the solute tank, the solute duct comprising a solute duct diameter that is equal to a third diameter of the mixing ring.

Present invention further proposes a method for dissolve a portion of solute in a portion of solvent, the method comprising the steps of set a required mixing ratio of solvent and solute in a solution, add a portion of solvent and a portion of solute in a mixing ring of a system for dissolve a portion of solute in a portion of solvent.

The method further comprises the step of measure a flow rate of the portion of solvent, prior the portion of solvent reaches the mixing ring and measure a flow rate of the portion of solute prior the portion of solute reaches the mixing ring, determine a real mixing ratio by dividing the measured flow rate of solvent by the measured flow rate of solute and compare said real mixing ratio with the required mixing ratio established.

BRIEF DESCRIPTION OF THE DRAWINGS

Present invention has been illustrated according to its preferred embodiment, which shows.

DETAILED DESCRIPTION OF THE PREFERRED EMBODIMENTS

In this preferred embodiment of the proposed mixing ring, mixing system and mixing method, the solvent can be preferably understood as being a portion of water and the solute can be preferably understood as being a portion of syrup.

Figure 1:
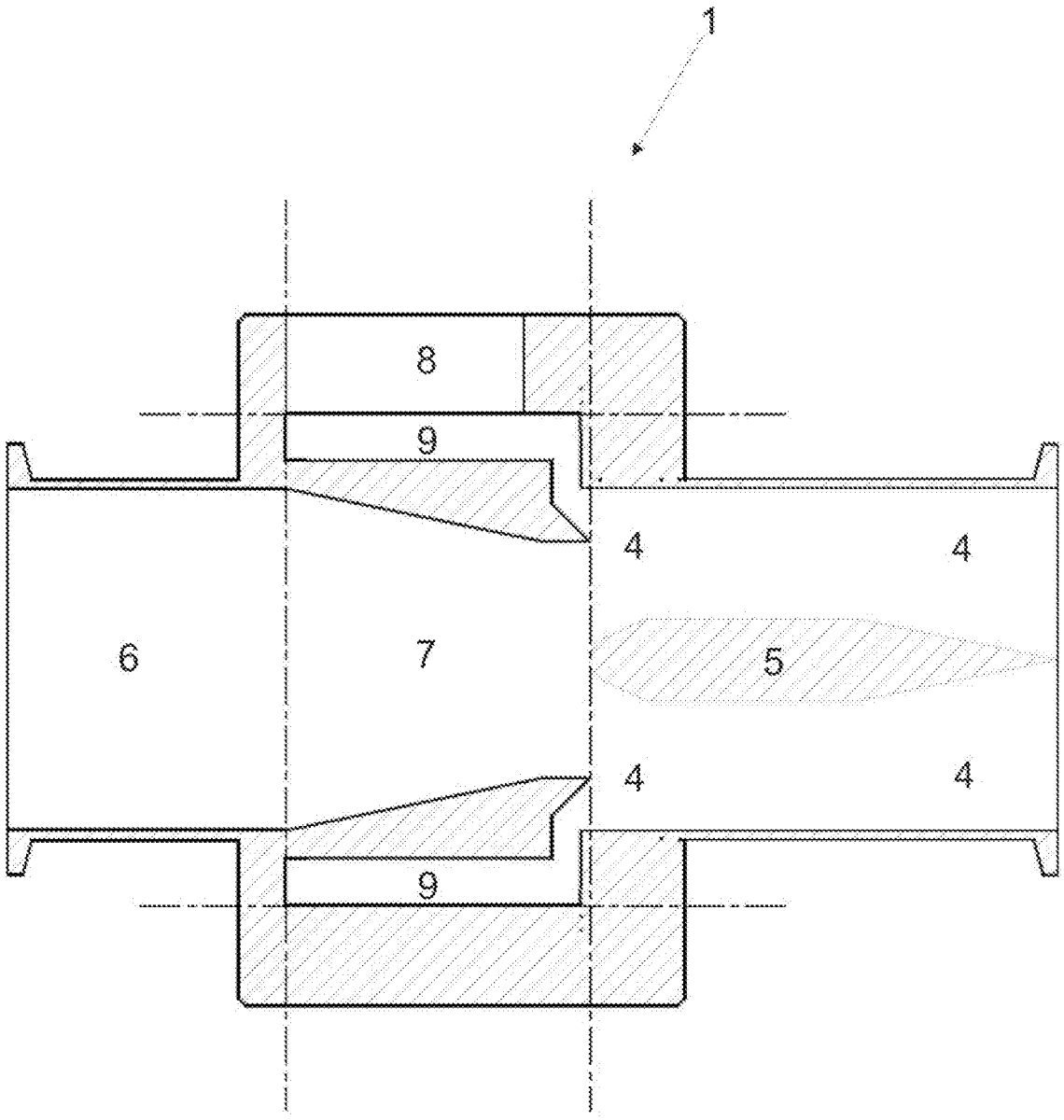
FIG. 1—Is a sectional view of the mixing ring proposed in the present invention.

FIG. 1 is a sectional view of the mixing ring 1 proposed in the present invention. For a better understanding of the proposed mixing ring 1, FIG. 1 will show it main segments and therefore each segment will be addressed related to its structural configuration and purpose.

In reference to FIG. 1, the proposed mixing ring 1 comprises:

A mixing path 4, a diffuser 5, a solvent input zone 6, a choke zone 7, a solute input zone 8 and a solute chamber 9. The solvent input zone 6 and the choke zone 7 defines a solvent input path 2, further, the solute input zone 8 and the solute chamber 9 defines a solute input path 3. The dotted lines showed in FIG. 1 represent the boundaries of each segment mentioned before.

Figure 2:
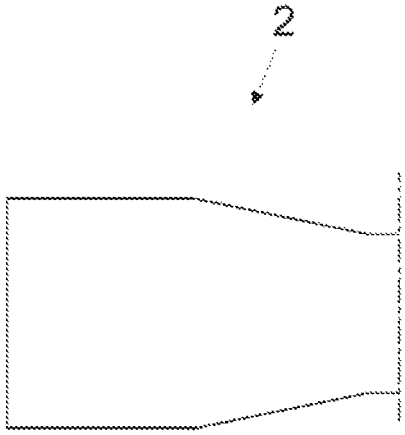
FIG. 2—Is a sectional view of the mixing ring, wherein FIG. 2 (*a*) shows the solvent input path, FIG. 2 (*b*) shows the solute input path and FIG. 2 (*c*) shows the mixing path.
Figure 2:
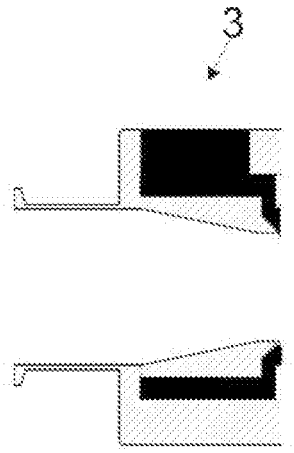
Figure 2:
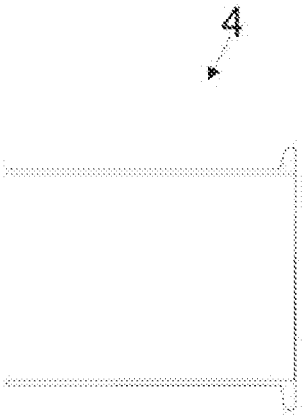

The solvent input path 2 and the solute input path 3 can be specifically seen from FIGS. 2 (*a*) and 2 (*b*) respectively. The mixing path 4 (without the diffuser) is shown in FIG. 2 (*c*).

Figure 3:
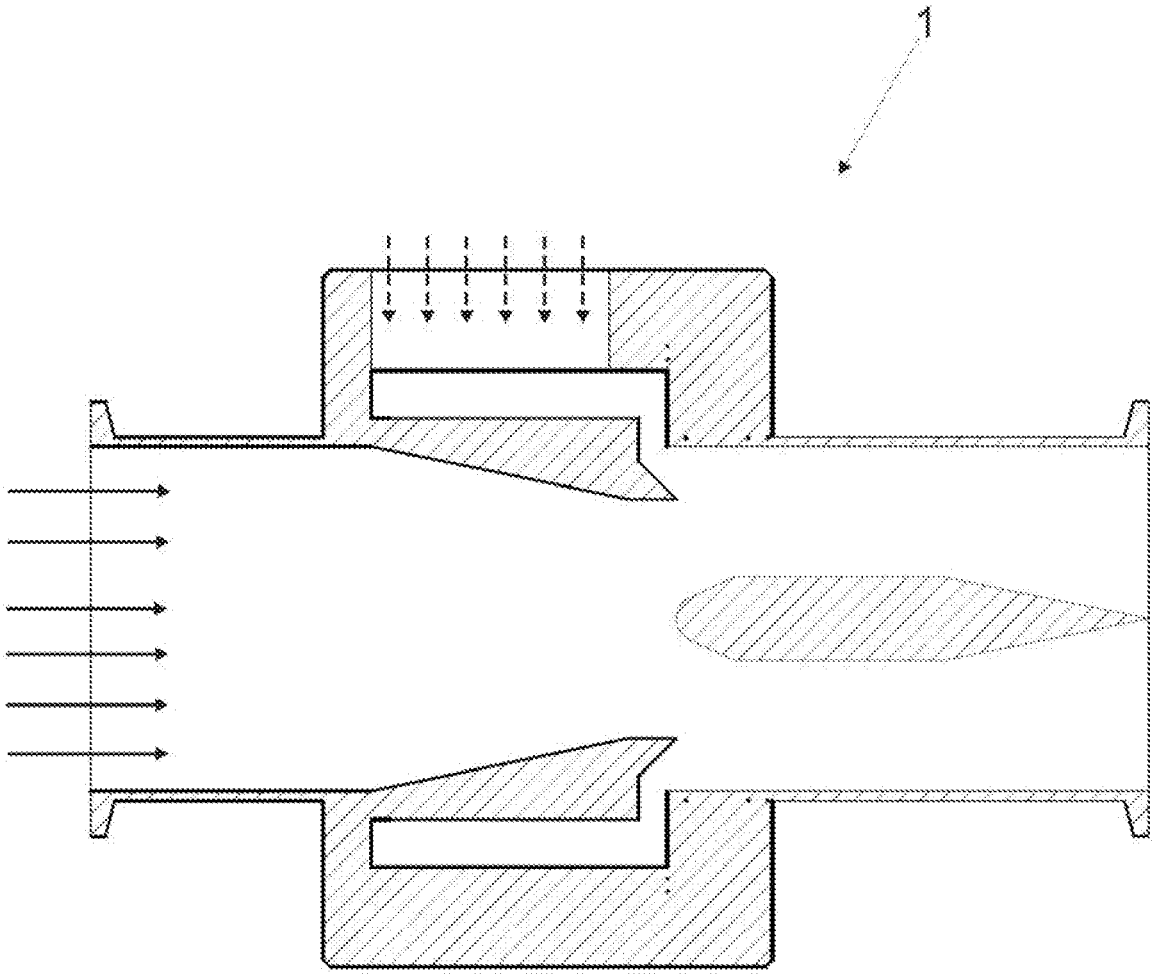
FIG. 3—Is a sectional view of the proposed mixing ring indicating the flowing of solvent and solute.

The solid arrows in FIG. 3 represent the portion of solvent which comes from a solvent tank (not shown) into the solvent input path 2, and, accordingly, the dotted arrows represent the portion of solute which comes from a solute tank (not shown) into the solute input path 3. In an alternative embodiment of the mixing ring 1 the solvent and solute could come from another reservoir not specifically being a tank.

Both solvent and solute are sucked by a pump which is placed nearby to the mixing ring 1, the location of such pump will be further addressed after the description of the structural configuration of the mixing ring 1 is completed.

Figure 4:
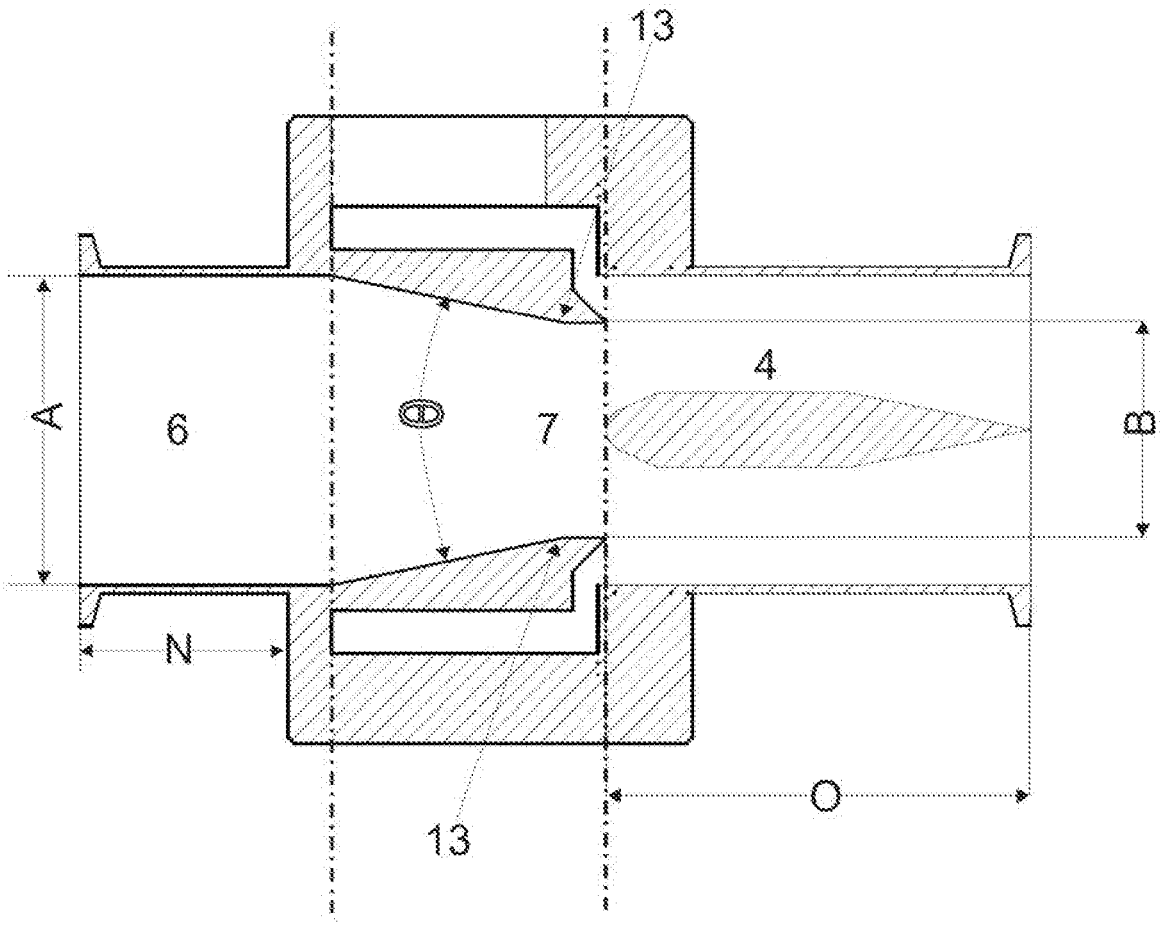
FIG. 4—Is a sectional view of the proposed mixing ring indicating its structure dimensions.

As can be better seen from FIG. 4, the interconnection between the solvent input zone 6 and the choke zone 7 establishes a first diameter A, which will be dependent from the total flow rate (solvent flow rate+syrup flow rate) that the mixing ring 1 is projected to mix (receive).

The table below shows preferably values for the first diameter A according to the total flow rate to be processed. As just mentioned, the values below are just preferably values which should not be considered a limitation.

| Total Flow Rate ($m^3/h$) | First Diameter A (millimeters) |
|---|---|
| ≥75 | Total flow rate × 1.55 |
| from 55 to 74 | Total flow rate × 1.75 |
| from 25 to 54 | Total flow rate × 1.8 |
| from 8 to 24 | Total flow rate × 2.25 |
| <8 | Total flow rate × 3 |

Regarding the solvent input zone length N, in this preferred embodiment of the mixing ring 1 it has the same dimension as the first diameter A.

Starting the convergence of the portion of solvent that is lead to the mixing path 4, the internal area of the solvent input path 2 is gradually reduced starting from the interconnection between the solvent input zone 6 and the choke zone 7 until a choke point 13 in the vicinity between the interconnection between the choke zone 7 and the mixing path 4.

Consequently, and in reference to FIGS. 2 to 4, a second diameter B is determined which will be between 50% and 65% of the first diameter A, as below:

| Total Flow Rate ($m^3/h$) | Second Diameter B (millimeters) |
|---|---|
| ≥75 | 0.5 * A-0.65*A |
| from 55 to 74 | 0.5 * A-0.65*A |
| from 25 to 54 | 0.5 * A-0.65*A |
| from 8 to 24 | 0.5 * A-0.65*A |
| <8 | 0.5 * A-0.65*A |

Regarding the mixing path length O, it is dependent of the first diameter A, specifically, in this preferred embodiment of the mixing ring 1, the mixing path length O of the mixing path 4 should be between 1.5 and 3.0 times the value of the first diameter A:

From the choke point 13 up to the border with the mixing path 4, the second diameter B is preferably kept constant (in order to correctly lead the solvent towards the mixing path 4), such configuration increases the efficiency of the mixing between the solute and the solvent. However, in an alternative embodiment of the mixing ring 1, the gradually reduction could continue directly up to the mentioned border.

The gradual reduction from the first diameter A to the second diameter B establishes a choke angle θ which can be considered the convergence angle of the mixing ring 1. Similarly to the first diameter A, the choke angle θ should be dependent from the total flow rate that the mixing ring 1 is projected to process.

The preferably values for the choke angle θ are disclosed in the following table:

| Total Flow Rate ($m^3$/h) | Angle θ (Grades) |
|---|---|
| ≥75 | 28 |
| from 55 to 74 | 25 |
| from 25 to 54 | 23 |
| from 8 to 24 | 20 |
| <8 | 17 |

Figure 5:
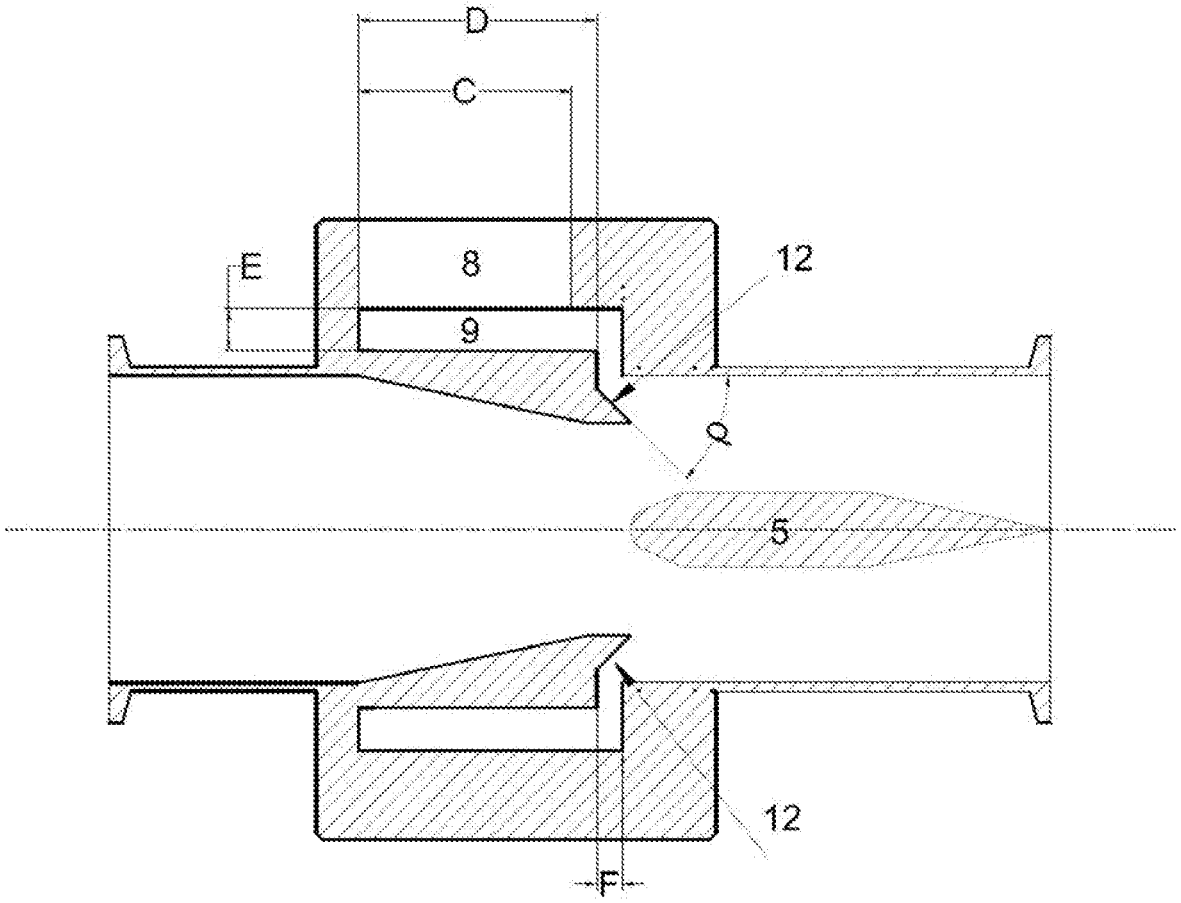
FIG. 5—Is a sectional view of the proposed mixing ring indicating the dimensions of the solute input path.

The structural configuration of the solute input path 3 will be specially addressed starting from FIG. 5.

The portion of solute is first introduced in the mixing ring 1 in the solute input zone 8, which has a third diameter C. The values of the third diameter C depends on the total flow rate that the mixing ring 1 should process. It can be seen that the third diameter C should preferably be between 50% and 65% the value of the first diameter A.

| Total Flow Rate ($m^3$/h) | Third Diameter C (millimeters) |
|---|---|
| ≥75 | 0.5 * A-0.65*A |
| from 55 to 74 | 0.5 * A-0.65*A |
| from 25 to 54 | 0.5 * A-0.65*A |
| from 8 to 24 | 0.5 * A-0.65*A |
| <8 | 0.5 * A-0.65*A |

It can be observed that the values are equivalent to the ones proposed for second diameter B, thus, in this preferred embodiment of the mixing ring 1, the second diameter B is equal to the third diameter C.

In order to perform a correct introduction of the portion of solute in the mixing path 4, the solute chamber width E should not assume large dimensions. In this preferred embodiment of the mixing ring, the solute chamber width E should preferably assume a value in the following range: $C/10 \leq E \leq C/3$. Reference to the third diameter C is made on FIG. 5.

In reference to FIG. 4, the value of the solute chamber width E is equivalent to the distance (length) from the choke point 13 up to the border with the mixing path 4.

With this preferred value, the portion of solute will be "compressed" and consequently lead to the open portion of the solute chamber 9, which will be sequentially addressed.

Figure 6:
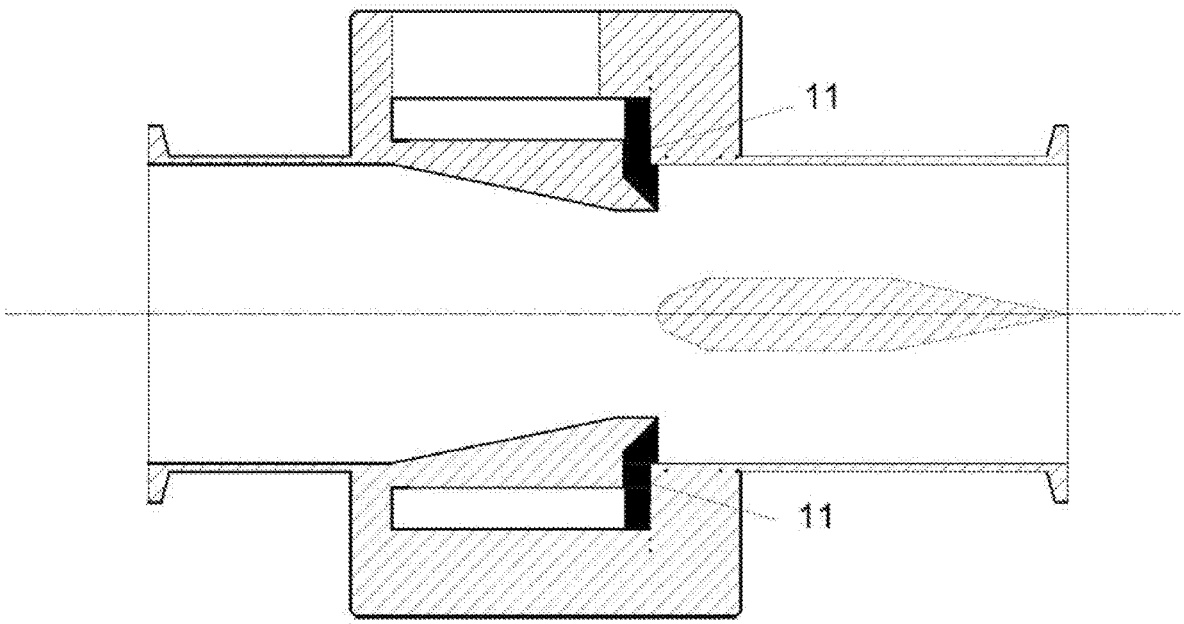
FIG. 6—Is a sectional view of the proposed mixing ring indicating the solute neck of the proposed mixing ring.

Prior to entering the mixing path 4, the portion of solute flows through a solute neck 11 which is represented by the highlighted dark area in FIG. 6. Structurally, and in reference to FIG. 5, the solute neck 11 establishes a second width F that is dependent from the fourth diameter D and from the first diameter A, consequently, the second width F depends from the flow rate of solvent and solute that the mixing ring 1 should receive.

Specifically, the second width F is obtained by the following expression:

$$F = \frac{D^2}{4 * A}$$

Making reference to FIG. 4, the value of the second width F is also the value of the distance from point 13 until the border with the mixing path 4.

Figure 7:
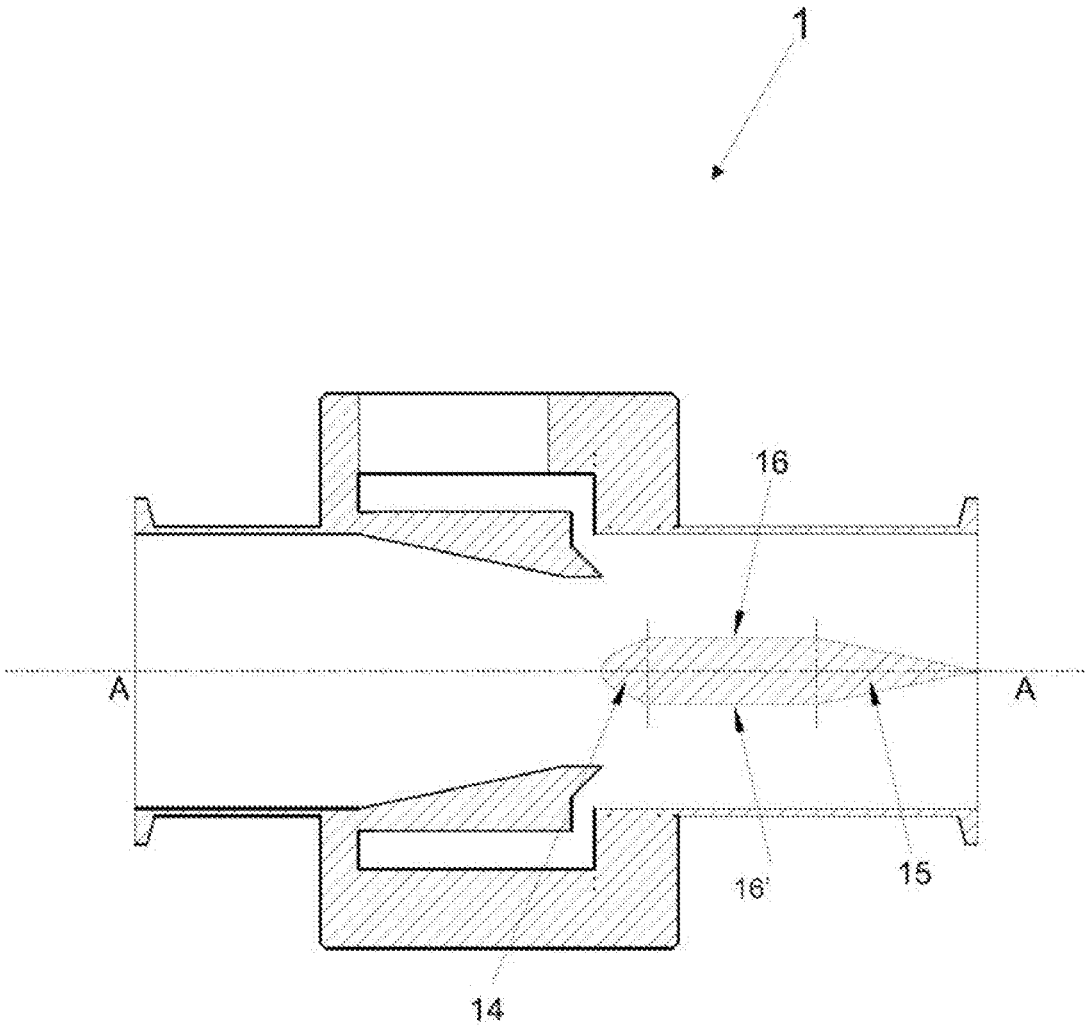
FIG. 7—Is a sectional view of the proposed mixing ring indicating the dimensions of the diffuser.

For a better introduction of the solute in the mixing path 4 the solute neck 11 defines a projection ramp 12 that is configured to lead the portion of solute toward the diffuser 5, more specifically, and in reference to FIG. 7, towards the straight segments 16 and 16' of the diffuser 5. The projection ramp 12 is formed on an outer surface of the choke zone 7 that extends around the second portion of the choke zone internal diameter that extends downstream from the choke point 13.

Preferably, the projection ramp 12 is a straight ramp, however, other configuration for the ramp 12 are acceptable, for example, a curved or serrated configuration.

The projection ramp 12 establishes a neck's angle ρ which in this preferably embodiment of the mixing ring 1 assume a value of 45°. This preferably value correctly lead the solute toward the diffuser 5, however, another values could be used if desired. Preferably, the greater the flow rate of syrup (solute), lesser will be the value of the neck's angle ρ.

After the portion of solute laves the solute neck 11, it enters the mixing path 4 wherein a diffuser 5 is placed at the center of the mixing ring 1. The structural configuration of the diffuser can be better seen from FIG. 7.

The way the diffuser is fixed in the mixing ring is not a main aspect of the proposed invention, it could be fixed by any method already publicly known.

As can be seen, the diffuser 5 is a symmetric structure wherein the symmetric axis is the longitudinal axis A-A of the mixing ring 1. The diffuser 5 is formed by two convex arcs, a first arc 14 and a second arc 15 oppositely displaced in relation to one another and connected by straight segments 16 and 16'.

Figure 8:
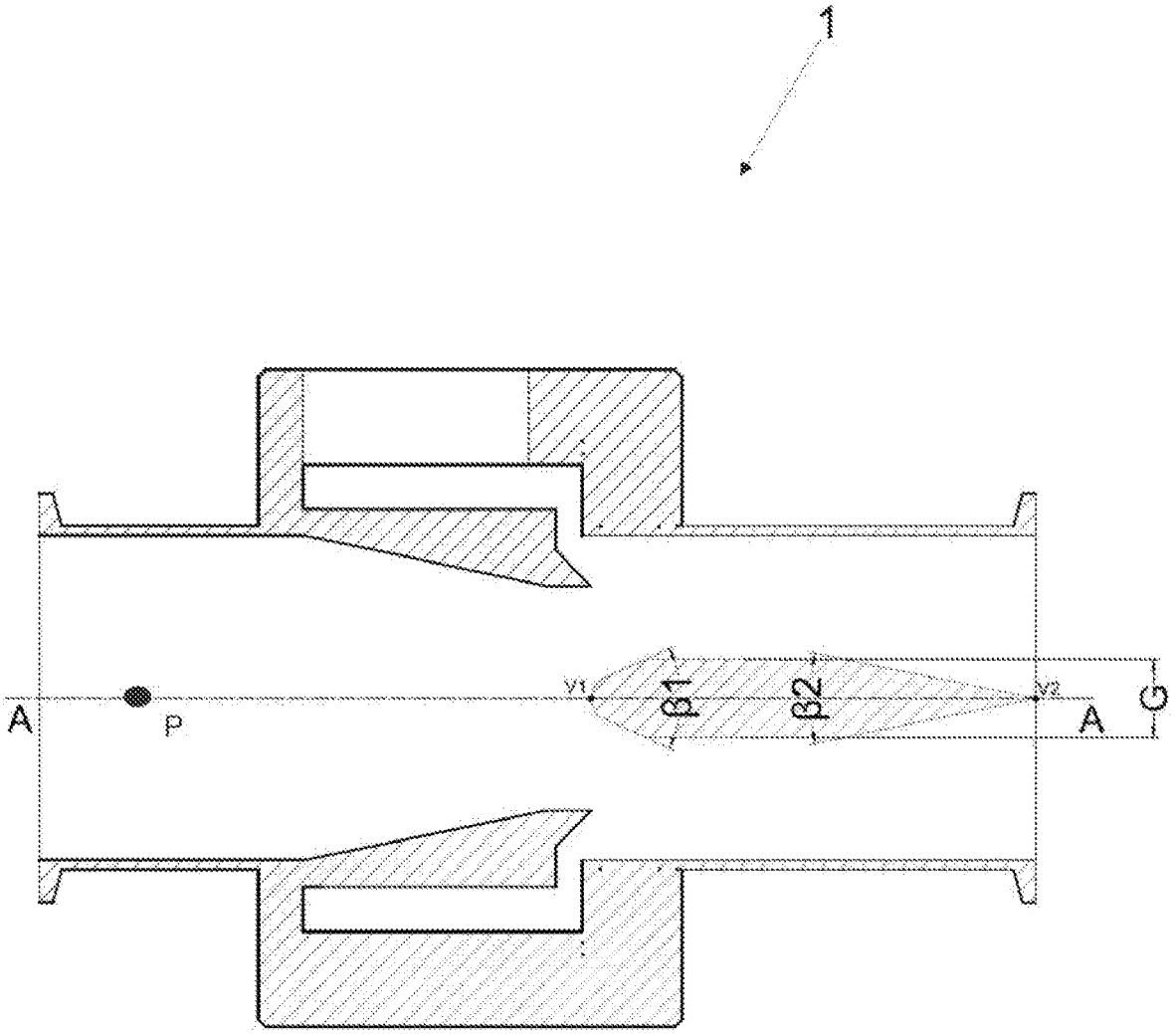
FIG. 8—Is an additional sectional view of the proposed mixing ring indicating the dimensions of the diffuser.

By oppositely displaced, it means that an observer located outside the diffuser (along the axis A-A of the mixing ring 1) and looking in its direction, would see a convex surface of one of the arcs, and consequently a concave surface of the other arc. For example, in reference to FIG. 8, an observer located at the point P would see the convex surface of the first arc 14 and the concave surface of the second arc 15.

Preferably, the diffuser vertices $V_1$ and $V_2$ of respectively the first and second convex arcs 14 and 15 are disposed in the longitudinal axis A-A of the mixing ring 1. Further, as can be better seen from FIG. 8, the aperture angles $\beta_1$, $\beta_2$ of the convex arcs of the diffuser 5 are different, wherein in this preferred embodiment of the mixing ring 1 the aperture angle $\beta_1$ of the first convex arc 14 should be greater than the aperture angle $\beta_2$ of the second convex arc 15.

The vertices $V_1$ and $V_2$ could define a concave/convex surface or alternatively could define a wedge surface (defining an arrow type surface), wherein the segments of each of the arcs connect at a single point.

Referring to numerical values, in a preferred embodiment the aperture angle $\beta_1$ should be around 55° and the aperture angle $\beta_2$ preferably around 20°. In a general terms, it can be mentioned that $\beta_1$ is at least twice the value of $\beta_2$.

Regarding its dimensions, the diffuser 5 length (the distance between the vertices V1 and V2) should preferably be 1.5 times the value of the first diameter A (a range from 1.3 and 1.6 is acceptable), further, the diffuser width G should be 25% the value of the first diameter A (a range between 23% and 26% is acceptable), as below:

| Total Flow Rate ($m^3$/h) | Width G (mm) | Length (mm) |
|---|---|---|
| ≥75 | 0.25 * A | 1.5 * A |
| from 55 to 74 | 0.25 * A | 1.5 * A |
| from 25 to 54 | 0.25 * A | 1.5 * A |
| from 8 to 24 | 0.25 * A | 1.5 * A |
| <8 | 0.25 * A | 1.5 * A |

Such structural configuration of the diffuser 5 leads the portion of solvent towards the portion of solute for consequently adding the solute in the solvent. Specifically, with the proposed mixing ring 1, the solvent displacement vectors are lead perpendicularly (a range from 75° to 105° would be acceptable) towards the solute displacement vectors, the encounter occurring in the mixing path 4 in the vicinity of the solute neck 11.

The mixing efficiency is increased since by placing the diffuser 5 in the center of the mixing ring 1, the solvent displacement velocity is reduced and therefore the solute dragging (drag of solute) occurs.

Further, after the encounter of the displacement vectors of solvent and solute, the diffuser's length should guarantee that such vectors would be aligned, for that reason, the values disclosed in the table above must be used.

Figure 9:
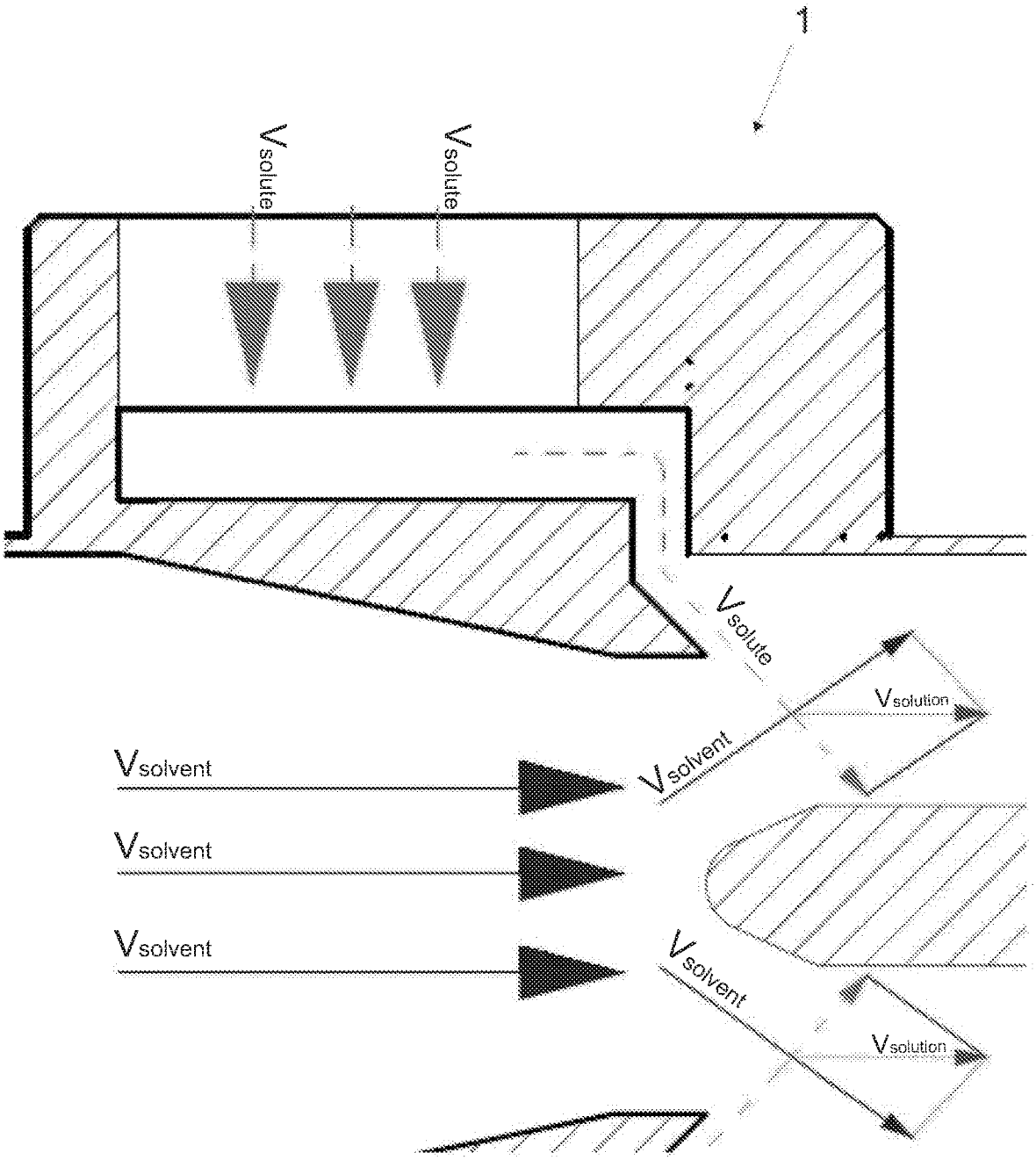
FIG. 9—Is a highlighted view of an internal area of the mixing ring disclosing the solvent and solute displacement vectors.

FIG. 9 is a highlighted view of the internal area of the mixing ring 1 disclosing the solvent displacement vectors ($V_{solvent}$) and the solute displacement vectors ($V_{solute}$). The solid lines represent the solvent vectors and the dotted lines represent the solute vectors.

FIG. 9 further shows the encounter of the solvent and solute, it can be seen that such vectors collide forming a perpendicular angle and therefore a resultant solution displacement vector ($V_{solution}$) that follows parallel to the straight segments 16 and 16' of the diffuser 5.

Regarding the placement of the diffuser 5 in the mixing ring 1, it can be observed from the figures (especially from FIG. 2(*a*)) that the diffuser 5 is completely placed in the mixing path 4, however, in an alternative embodiment of the mixing ring 1, a small portion of the first convex arc 14 could join the solvent input path 2.

In an additional alternative embodiment of the mixing ring 1, the diffuser could be relocated (moved, dislocated) along the longitudinal axis (A-A) of the mixing ring (entering the choke zone 7). Such feature allows a great control of the solute/solvent displacement vectors and therefore the control of the region wherein the vectors would crash (encounter).

In a further alternative embodiment of the proposed mixing ring 1, it could be projected without the diffuser 5, in this sense, the structural configuration of the choke zone 7 would lead the portion of solvent towards the portion of solute.

In the embodiment wherein the mixing ring is projected without the diffuser, the proposed values for the choke angle (θ) would be the same as the embodiment with the diffuser, further the portion of solvent would be lead towards the portion of solute in an angle between 45° and 9 0°.

Have been described the proposed mixing ring 1 to dissolve a portion of solute in a portion of solvent, it will now be addressed a system wherein such mixing ring 1 is preferably used, in other words, a system for dissolving a portion of solute in a portion of solvent 25 will now be described (also referred to as system 25).

Figure 10:
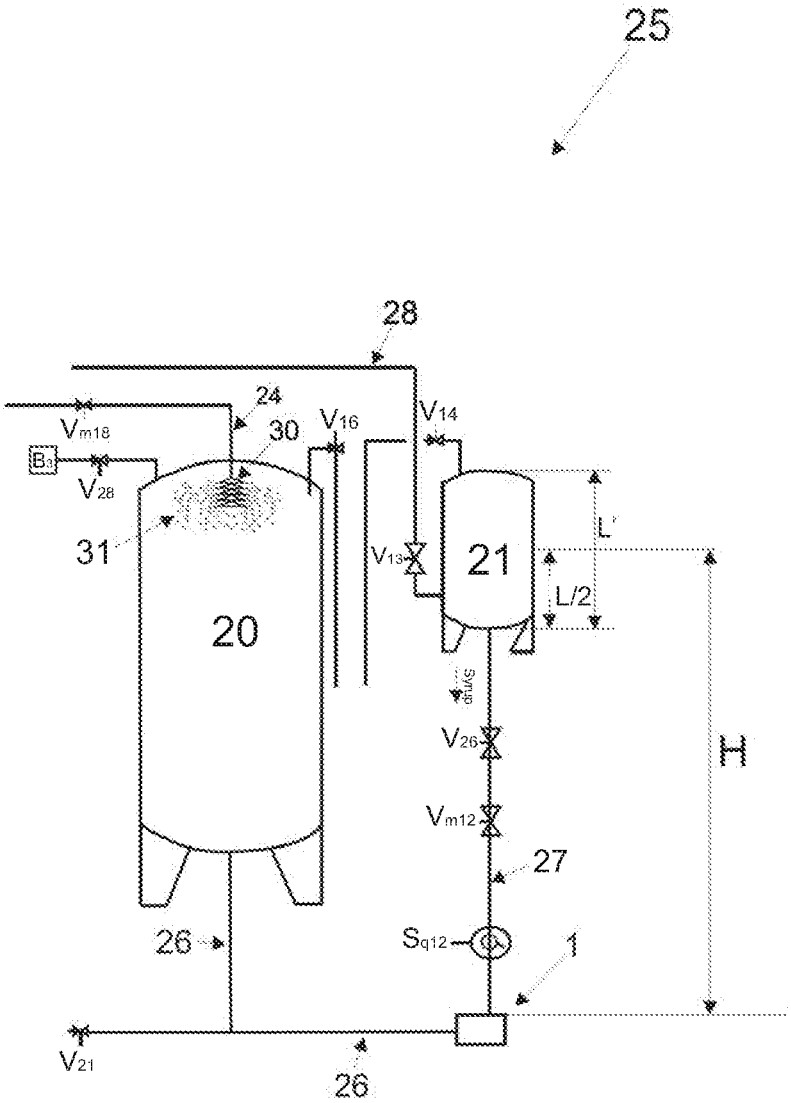
FIG. 10—Is a general view of the system for dissolve a portion of solute in a portion of solvent proposed in present invention.

FIG. 10 represents a general preferred embodiment of the proposed system 25. Such figure illustrates the main components and ducts (pipes) of the system 25, not showing all of their valves and other ducts that will be described in sequence.

As can be seen from FIG. 10, the system 25 comprises a solvent tank 20 and a solute tank 21 associated to a mixing ring 1, said mixing ring 1 is, in a preferably embodiment of the system 25, the mixing ring 1 described above and proposed in present application.

The tanks 20 and 21 are configured to store respectively the portion of solvent and the portion of solute that will be later mixed in the mixing ring 1. The connection of the solvent tank 20 and the mixing ring 1 is done by a solvent discharge duct 26, as shown in FIG. 10.

As can be seen from FIGS. 4 to 10, a first end of the solvent discharge duct 26 is preferably associated to a bottom portion of the solvent tank 20. Further, the solvent duct is preferably a tubular structure with a solvent duct diameter that is equal to a first diameter A of the mixing ring 1. The opposite end of the solvent discharge duct 26 is connected to a solvent input zone 6 of the mixing ring 1.

As can be further seen from FIGS. 5 and 10, the system 25 further comprises a solute discharge duct 27 configured to lead the portion of solute from the solute tank 21 to the mixing ring 1. Similarly to the solvent discharge duct 26, the solute discharge duct 27 is a tubular structure with a solute duct diameter that is equal to a third diameter C of the mixing ring 1.

As best seen from FIG. 10, a first end of the solute discharge duct 27 is preferably associated to a bottom portion of the solute tank 21, consequently, the opposite end is connected to the mixing ring 1. Preferably, the association of both solvent discharge duct 26 and solute discharge duct 27 to the solvent tank 20, solute tank 21 and mixing ring 1 is done by a welding process.

Preferably, the connection between the solvent discharge duct 26 and the solute discharge duct 27 with the bottom portion of respectively the tanks 20 and 21 should not be considered as a limitation as shown in FIG. 10. Such connection could be done in other parts of the tanks 20 and 21 (for example, at the sides of the tank), having to be placed below the operation level of the reservoirs.

In order to keep a constant pressure in the mixing ring 1, the solute tank 21 (reservoir) should be disposed at a certain distance (height) from the mixing ring 1.

In this preferred embodiment of the system 25, the solute reservoir 21 is placed between 1700 millimeters (mm) and 1900 mm from the connection between the solute discharge duct 27 and the mixing ring 1 until half of the solute reservoir 21 total height L'. Preferably, the solute discharge duct 27 should be vertically disposed between the mixing ring 1 and the tank 21.

Consequently, in reference to FIG. 10, a first height H should preferably be around 1700 mm and 1900 mm. The mentioned relation between the first height H and the total height L' of the solute reservoir 21 should be kept independently of the volume of the solute reservoir.

The mentioned preferred range of values for the first height H establish a minimum pressure (150 g/$cm^2$) in the solute reservoir 21, such pressure allows the flow of syrup (solute) from the tank 21 until the mixing ring 1.

The point of connection between the solute inlet duct 28 and the solute tank 21 could be as shown in FIG. 10 or, alternatively, in the opposite side of the solute tank 21. It is important to mention that such point of connection should be placed at locations 10% of the total height L' of the solute tank (counted from the base of the tank and excluding their support feet).

Like the solute discharge duct 27, the solute inlet duct 28 is a tubular structure with a diameter which depends on the maximum flow rate of solute that the system should process. In other words, the diameter of the solute inlet duct 28 is equal to the diameter of the solute discharge duct 27 which is equal to the third diameter C of the mixing ring 1.

The input of solute in the tank 21 is done by managing (opening/closing) a solute inlet valve $V_{13}$. Additionally, the system 25 further comprises a solute vent valve $V_{14}$ which should be kept open during all the mixing process and in order to preserve the pressure of the solute tank 21 at atmospheric pressure.

In the solute discharge duct 27, the system 25 further comprises a solute discharge valve $V_{26}$. A solute modulating valve $V_{m12}$ is also used in order to better manage the flow rate of solute that is lead to the mixing ring 1.

A solute flowmeter $S_{q12}$ may be disposed between the mixing ring 1 and the solute modulating valve $V_{m12}$ to check the flow rate of solute that enters the mixing ring 1. In the proposed system 25, it is important to measure the solute flow rate in order to maintain balance between (compensate) the solvent and solute mixing ratio. The balance is done by managing the solute modulating valve $V_{m12}$ opening.

Preferably, the tank 21 may comprise any method of cleaning, like the use of a wash ball (not shown). Any other method known to clean the tank could be used.

The solvent is added into the solvent tank 20 from a solvent source (not shown) and through a solvent inlet duct 24. Preferably, the solvent inlet duct 24 diameter should be equal to the diameter of the solvent discharge duct 26 and consequently equal to the first diameter A of the mixing ring 1.

In a preferred embodiment of the system 25, the solvent is added in the top portion of the tank 20 (reference is made to FIG. 11) by controlling a solvent modulating valve $V_{m18}$. The control (opening/closing) of the solvent modulating valve $V_{M18}$ allows the level of the solvent tank 20 to be kept constant independently of the solvent flow rate demanded by the system.

Alternatively, the solvent could be added by any of sides of the tank, as long as it is added in a rainy way (will be described in details below) and in a region of the tank that does not have contact with the solvent (region that does not have liquid).

As can be seen from FIG. 10, the proposed system 25 further comprises a deflector cone 30 which is disposed inside the solvent tank 20 (preferably in its top portion) and connected to one end of the solvent inlet duct 24.

The deflector cone 30 allows the level of the tank 20 to be kept constant and further allows the solvent to be added into the tank 20 in a rainy way, such feature deoxygenates (removes the oxygen from) the solvent and therefore increases the contact between the vacuum at the top portion of the solvent tank 20 and the plurality of solvent drops 31 that leaves the cone deflector 30.

In other words, the cone deflector 30 is configured to spread (atomize, spray) the portion of solvent into a plurality of solvent drops 31.

The use of the deflector cone 30 as shown in FIG. 10 is just a proffered embodiment of a way to add solvent in the tank 20 in a rainy way, however, other methods known in the art could be used which purpose is to add solvent in drops (rainy way).

The vacuum at the top portion of the solvent tank 20 is preferably generated by a vacuum pump $B_3$ of any kind known in the prior art. The configuration of such pump is not the main aspect of the proposed system 25. Further, associated to the vacuum pump $B_3$, the system 25 preferably comprises a vacuum valve $V_{28}$ that closes if the solvent tank 20 floods.

The vacuum level in the solvent tank 20 should be kept between −50 g/cm$^2$ and 150 g/cm$^2$, such range values allow the constant solvent flow rate in the mixing ring 1 (solvent input zone 6).

The solvent tank 20 should further preferably comprise a solvent tank vent valve $V_{16}$ that opens and has the objective to release the pressure when the level of solvent is increased above its maximum level.

The solvent tank level is preferably controlled by a guided wave radar (not shown) that could be of any type known in the prior art. Any other method or equipment that is able to measure a level of a certain liquid could be used.

In a preferred embodiment of the proposed system 25, it further may comprise a pressure sensor (not shown) that allows the monitoring of the solvent tank 20 vacuum level. Finally, the solvent tank 20 further comprises a solvent tank 20 discharge valve $V_{21}$ that could be used if the drainage of the solvent in the tank 20 is necessary.

Figure 11:
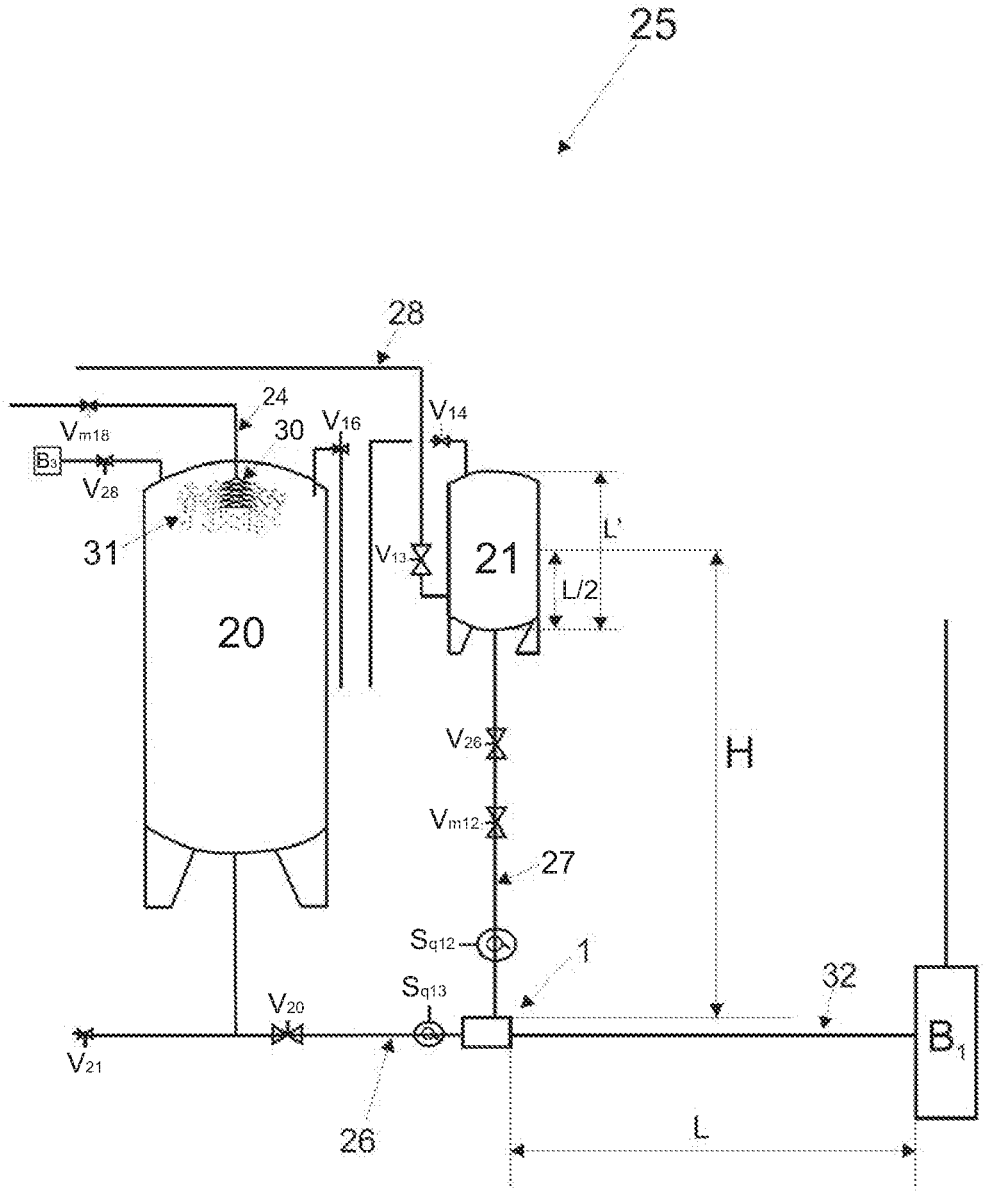
FIG. 11—Is an additional view of the system for dissolve a portion of solute in a portion of solvent.

FIG. 11 is an additional view of the system for dissolving a portion of solute in a portion of solvent 25 as proposed in present invention. FIG. 11 shows additional components of the system 25 if compared to FIG. 9.

As can be seen from FIG. 11, the system 25 comprises a main pump $B_1$ that is placed adjacently (in connection) to the mixing ring 1. The pump $B_1$ is configured to suck the solvent and solute into the mixing ring 1, and, after the mixing process is completed, the solution is lead to a carbonation system (not disclosed).

The main pump $B_1$ should be disposed in a preferred range distance from the mixing ring 1 and, preferably, the pump $B_1$ is disposed at the same height with the mixing ring 1. For same height, it means that the duct that connects (associates) the mixing ring 1 with the main pump $B_1$ is leveled.

The preferred range distance between the main pump $B_1$ and the mixing ring 1 is referred as a mixing distance L, as can be seen from FIG. 11. The value of the mixing distance L depends from the value of the first diameter A of the mixing ring 1, and, consequently, the mixing distance L depends from the maximum solvent flow rate that the system 25 is designed to receive.

In a preferred embodiment, the value of the mixing distance L is between 5 and 11 times the value of the first diameter A. If values smaller than 5 were used, it could generate unwanted turbulence in the mixing path 4 of the mixing ring 1, on the other side, with values greater than 11, the main pump $B_1$ power should also be increased.

The duct that connects the mixing ring 1 with the main pump $B_1$ is referred as a carbonation duct 32, preferably configured as a tubular structure with internal diameter being equal to the first diameter A of the mixing ring 1. The duct 32 should be connected to the mixing path 4 of the mixing ring 1 and further, the first diameter A is preferably kept in the tubular structure that connects the main pump $B_1$ with the carbonation system (not shown).

Further, a locking valve $V_{20}$ is preferably disposed in the solvent discharge duct 26. The locking valve $V_{20}$ should be closed in order to interrupt the solvent flow in the duct 26 when desired. Additionally, as can be seen from FIG. 11 a solvent flowmeter $S_{q13}$ is preferably disposed close by the mixing ring 1 so the flow rate of solvent that enters the mixing ring 1 can be appropriately measured.

The distance between the mixing ring 1 and the solvent flowmeter $S_{q13}$ may be preferably equal or greater than five times the value of the first diameter A.

Having described a preferred system for dissolving a portion of solute in a portion of solvent 25 and further a preferred structural configuration for a mixing ring 1 used in such system 25, a preferred method for dissolve a portion of solute in a portion of solvent will now be addressed.

The method and consequently the valves and pumps that comprise the proposed system are preferably controlled by a Human Machine Interface (HMI). The details of such HMI are not necessary to be described since it is not the main aspect of present invention. Any HMI able to manage valves and pumps known in the prior art teachings could be used. In an alternative embodiment, the method could be manually operated.

During the mixing process, the solute vent valve $V_{14}$ and the vacuum valve $V_{28}$ should be kept open, further, the vacuum pump $B_3$ is triggered to generate vacuum in the solvent tank 20.

Preferably, the vacuum pump $B_3$ should be kept activated while the mixing is in progress and a few minutes before the start of the mixing.

The vacuum pump $B_3$ should be activated, the vacuum valve $V_{28}$ and the solute vent valve $V_{14}$ opened, solvent should be added to the solvent tank 20. Consequently, the solvent modulating valve $V_{m18}$ should be opened in order to keep the solvent volume constant inside the tank 20.

Preferably, the solvent volume in the solvent tank 20 should be kept constant in order to maintain a constant solvent flow rate in the mixing ring 1. The volume of the solute tank 21 is controlled by the actuation (opening/closing) of the solute inlet valve $V_{13}$ according to the desired solute volume.

When the main pump $B_1$ starts to pull (suck) solvent and solute, the volume in the solvent tank 20 should be kept constant, as mentioned before, however, the volume in the solute tank 21 can vary.

During the mixing, the locking valve $V_{20}$ and the solute discharge valve $V_{26}$ should be opened. As mentioned before, the solute vent valve $V_{14}$ and the vacuum valve $V_{28}$ should still be open, vacuum pump $B_3$ should be triggered and valves $V_{m18}$ and $V_{13}$ should also be opened.

Concomitant to the opening of the locking valve $V_{20}$ and solute discharge valve $V_{26}$, the solute modulating valve $V_{m12}$ should be opened. The opening percentage of the solute modulating valve $V_{m12}$ should be equal to the average opening percentage of the last mixing production done (if the system is used without solvent and solute flowmeters) or can be controlled according to the solvent and solute flow rates measured by the flowmeters $S_{q12}$ and $S_{q13}$.

If no flowmeters are used, and in order to achieve such average opening, the PLC should store every percentage of opening of the solute modulating valve $V_{m12}$ that was previously used in a mixing cycle to prepare a determined flavor (solution).

Consequently, it is assured that when a new mixing process is started, the solute flow rate will be around (or close to) the desired flow rate to prepare the desired flavor.

If flowmeters are used, and as the main pump $B_1$ is triggered, the solvent and solute flowmeters $S_{q13}$ and $S_{q12}$ start to measure the flow rate of solvent and solute, respectively.

The real mixing ratio is achieved by the division of the solvent flow rate and the solute flow rate. Said real mixing ratio should be compared with a required mixing ratio, the required mixing ratio is the relation of solvent and solute that the final solution should have, such required mixing ratio is determined by the operator of the proposed method, using the HMI.

If the difference between the real mixing ratio (flow rate division) and the required mixing ratio is positive, the opening percentage of the solute modulating valve $V_{m12}$ should be increased ($V_{m12}$ is open) until the difference between the real mixing ratio and the required mixing ratio reaches zero.

If the difference results in a negative value, the opening percentage of the solute modulating valve $V_{m12}$ should be decreased ($V_{m12}$ is closed) until the difference reaches zero.

For example, if the required mixing ratio established in the PLC is 4 $m^3/h$ and the solvent flowmeter $S_{q13}$ measures a flow rate of 6 $m^3/h$ and the solute flowmeter $S_{q12}$ measures a solute flow rate of 2 $m^3/h$. The real mixing ratio will be 6 $m^3/h/2$ $m^3/h=3$ Therefore, the difference between the real mixing ratio (3) and the required mixing ratio (4) would be negative (−1). Thus, as mentioned above, the opening percentage of the solute modulating valve $V_{m12}$ should be closed until the solute flowmeter $S_{q12}$ measures a solute flow rate of 1.5 $m^3/h$.

With a solute flow rate of 1.5 $m^3/h$ the real mixing ratio will be 4 and therefore the difference between the real mixing ratio (4) and the required mixing ratio (4) will be zero.

The PLC can be set to manage the opening percentage of the solute modulating valve $V_{m12}$ until the comparison (difference) reaches exactly zero or a value substantially equal to zero. The acceptable tolerance will obviously depend on the application that the system is used and in its accuracy (chemical, food industry, pharmaceutical industry).

The comparison between the required mixing ratio and the real mixing ratio is automatically done, in real time, by the PLC, as well the opening/closing (managing) of the solute modulating valve $V_{m12}$.

As the mixing ring 1 structural configuration conserves the proportionality of solute with solvent, the necessity of correction (management) of solute flow rate is reduced.

In an alternative embodiment, and as mentioned before, there would be no need in the use of the flowmeters $S_{q12}$ and $S_{q13}$. The mixing ratio could be determined only by setting the opening percentage of the solute modulating valve $V_{m12}$ according to the last average opening values stored in the PLC, since the variation of solvent flow rate will automatically result in a solute flow rate variation.

Further, despite the above described method only mentioned the management of the solute modulating valve $V_{m12}$ the percentage of opening while the solvent modulating valve $V_{m18}$ was kept in a fixed opening percentage, in an alternative embodiment, the method could be executed by managing the opening percentage of the solvent (water) modulating valve $V_{m18}$ while the opening of the syrup (solute) modulating valve $V_{m12}$ could be kept fixed.

Further, the solute mentioned in the present invention should not be restricted as a portion of syrup, preferably, any material with a viscosity inferior or equal to 170 cPs can be used in the proposed mixing ring 1, system 25 and method. For example, the solute could be: high fructose corn syrup, alcohol, vinegar, detergents, liquid cleaners (residential/commercial), among others.

Similarly, the portion of solvent should not be restricted as a portion of water. Preferably, any material with a viscosity equal or inferior to 80 cPs could be used, for example, water or carbonated water.

Further, the application field of the proposed mixing ring 1, system 25 and method for dissolve a portion of solute in a portion of solvent should not be restricted to the beverage industry. The invention can be further used in the chemical and pharmaceutical industry, and further in the hospital sector.

Independently of the application field, it is important to keep the limitations in the solvent and solute viscosities, as mentioned above.

Further, when used in the beverage industry, the application of the proposed mixing ring 1 and method should not be restricted to large scale systems. The proposed invention could be used in small scale systems, like, just in a preferably example, in small sized beverage mixing machines, such as those used in fast food restaurants or even in home or kitchen appliances.

Independently of the application field, it is important to respect the mixing ring 1 and system 25 dimensions according to the total flow rate that should be processed.

Preferred embodiments having been described, one should understand that the scope of the present invention embraces other possible variations, being limited only by the contents of the accompanying claims, which include the possible equivalents.

The invention claimed is:

1. A mixing ring for dissolving a portion of solute in a portion of solvent, the mixing ring comprising:

a solvent input path and a solute input path fluidly associated to a mixing path, wherein, the solvent input path is configured to receive a portion of solvent and the solute input path is configured to receive a portion of solute, the mixing ring is structurally configured to lead the portion of solvent and the portion of solute in a downstream direction to the mixing path, said downstream direction being opposite an upstream direction, and the mixing ring further comprises a diffuser mostly placed in an internal area of the mixing path, the diffuser is configured to lead the portion of solvent towards the portion of solute, wherein the solute input path comprises a neck including a projection ramp configured to lead the portion of solute toward the mixing path and the diffuser, the projection ramp establishing a neck angle in relation to an internal wall of the mixing ring, wherein the neck angle is defined between the projection ramp and the internal wall of the mixing ring and is an acute angle, wherein the solvent input path is configured as a solvent input zone associated to a choke zone, the choke zone disposed between the solvent input zone and the mixing path, wherein a first border provides a first boundary between the solvent input zone and the choke zone and establishes a first diameter, and a second border provides a second boundary between the choke zone and the mixing path and establishes a second diameter which is smaller than the first diameter, the internal diameter of the choke zone including a first portion that is gradually decreasing from the first diameter to the second diameter and including a second constant diameter portion that extends in the downstream direction from the second diameter toward said mixing path, wherein the projection ramp of the neck is formed on an outer surface of the choke zone that extends around the extending second portion of the internal diameter of the choke zone such that said projection ramp establishes the second border between the choke zone and the mixing path, wherein the choke zone extends from the second border in the upstream direction toward the solvent input zone and the mixing path extends from the second border in the downstream direction.

2. The mixing ring according to claim 1, wherein the internal diameter of the choke zone gradually decreases from the first diameter to the second diameter until a point located upstream of the second border that delimits the choke zone and the mixing path.

3. The mixing ring according to claim 2, wherein the value of the second diameter is between 50% and 65% of the value of the first diameter, further, a length of the mixing path is between 1.5 and 3.0 times the value of the first diameter.

4. The mixing ring according to claim 3, wherein the solute input path comprises a solute input zone and a solute chamber, the solute input zone establishes a third diameter and the solute chamber establishes a fourth diameter which is greater than the third diameter, the third diameter being equal to the second diameter of the mixing ring.

5. The mixing ring according to claim 4, wherein the solute chamber establishes a first width, assuming a value in the following range: $C/10 \leq E \leq C/3$, wherein E represents the first width and C represents the third diameter.

6. The mixing ring according to claim 5, wherein the solute input path further comprises the solute neck associated to the solute chamber, the solute neck establishing a second width.

7. The mixing ring according to claim 6, wherein the diffuser is a symmetric structure wherein the symmetric axis is the longitudinal axis of the mixing ring, the diffuser further comprises a first convex arc and a second convex arc oppositely displaced in relation to one another and connected by straight segments.

8. The mixing ring according to claim 7, wherein the projection ramp is configured to lead the portion of solute toward the straight segments of the diffuser.

9. The mixing ring according to claim 8, wherein vertices of respectively the first and second convex arcs are disposed in the longitudinal axis of the mixing ring.

10. The mixing ring according to claim 9, wherein the distance between the vertices is between 1.3 and 1.6 times greater the value of the first diameter and the diffuser width is between 23% and 26% the value of the first diameter.

11. The mixing ring according to claim 10, wherein the convex arcs respectively establish a first aperture angle and a second aperture angle, wherein the value of the first aperture angle is at least twice the value of the second aperture angle.

12. The mixing ring according to claim 11, wherein the choke zone defines a choke angle in the range from 15° to 30°.

13. The mixing ring according to claim 12, wherein the solvent input path receives the portion of solvent from a solvent tank and the solute input path receives the portion of solute from a solute tank.

14. A mixing ring for dissolving a portion of solute in a portion of solvent the mixing ring comprising:

a solvent input path and a solute input path fluidly associated to a mixing path, wherein, the solvent input path is configured to receive a portion of solvent and the solute input path is configured to receive a portion of solute, the mixing ring is structurally configured to lead the portion of solvent and the portion of solute in a downstream direction to the mixing path, said upstream direction being opposite the downstream direction, and, the mixing ring further comprises a choke zone structurally configured to lead the portion of solvent towards the portion of solute, wherein the solute input path comprises a neck including a projection ramp configured to lead the portion of solute toward the mixing path, the projection ramp establishing a neck angle in relation to an internal wall of the mixing ring, wherein the neck angle is an acute angle defined between the projection ramp and the internal wall of the mixing ring, wherein the solvent input path comprises a solvent input zone associated to the choke zone, the choke zone disposed between the solvent input zone and the mixing path, wherein a first border provides a first boundary between the solvent input zone and the choke zone and establishes a first diameter, and a second border provides a second boundary between the choke zone and the mixing path and establishes a second diameter which is smaller than the first diameter, the internal diameter of the choke zone including a first portion that is gradually decreasing from the first diameter to the second diameter and including a second constant diameter portion that extends in the downstream direction from the second diameter toward said mixing path, wherein the projection ramp of the neck is formed on an outer surface of the choke zone that extends around the extending second portion of the internal diameter of the choke zone such that the projection ramp establishes the second border between the choke zone and the mixing path, the choke zone extending from the second border in the upstream direction toward the solvent input zone and the mixing path extending from the second border in the downstream direction.

15. The mixing ring according to claim 14, wherein the choke zone defines a choke angle in the range from 15° to 30°.

16. The mixing ring according to claim 15, wherein the internal diameter of the choke zone gradually decreases from the first diameter to the second diameter until a point located upstream of the second border that delimits the choke zone and the mixing path, and wherein the solute input path comprises a solute input zone and a solute chamber, the solute input zone establishes a third diameter and the solute chamber establishes a fourth diameter which is greater than the third diameter.

17. The mixing ring according to claim 16, wherein the solute chamber establishes a first width, assuming a value in the following range: $C/10 \leq E \leq C/3$ wherein E represents the first width and C represents the third diameter, and the solute input path further comprises the solute neck associated to the solute chamber, the solute neck establishing a second width and the projection ramp, the projection ramp configured to lead the portion of solute toward the mixing path.

18. A mixing ring for dissolving a solute in a solvent, the mixing ring being placed along pipes where a solute stream and a solvent stream are to be mixed and comprising:

a solvent input path configured as a solvent input zone and associated to a choke zone, the choke zone disposed between the solvent input zone and a mixing path, wherein a first border provides a first boundary between the solvent input zone and the choke zone and establishes a first diameter, and a second border provides a second boundary between the choke zone and the mixing path and establishes a second diameter which is smaller than the first diameter, the internal diameter of the choke zone including a first portion that is gradually decreasing from the first diameter to the second diameter and including a second constant diameter portion that extends in a downstream direction from the second diameter toward said mixing path, wherein an upstream direction is opposite said downstream direction, a solute input path comprising a solute neck including a projection ramp configured to lead the portion of solute toward the mixing path, the projection ramp establishing a neck angle in relation to an internal wall of the mixing ring, wherein the neck angle is an acute angle defined between the projection ramp and the internal wall of the mixing ring, and the solvent input path being placed upstream of the solute neck, both the solvent input path and the solute input path being fluidly connected to each other and leading to the mixing path, the mixing path being placed downstream from the second border and the choke zone being located in the upstream direction from the second border, the solute input path being fluidly connected to the mixing path by the solute neck leading the solute towards a stream of solvent exiting the choke zone such that a solute stream and the solvent stream substantially orthogonally collide with each other, wherein the projection ramp of the solute input path is formed on an outer surface of the choke zone that extends around the extending second portion of the internal diameter of the choke zone such that the projection ramp establishes the second border between the choke zone and the mixing path, the choke zone extending from the second border in the upstream direction toward the solvent input path and the mixing path extending from the second border in the downstream direction.

19. The mixing ring for dissolving a solute in a solvent according to claim 18, wherein a diffuser is placed downstream from the choke zone, the diffuser being configured to lead the solvent stream towards the solute stream.

20. A mixing ring for dissolving a portion of solute in a portion of solvent, the mixing ring comprising:

a solvent input path and a solute input path fluidly associated to a mixing path, wherein, the solvent input path is configured to receive a portion of solvent and the solute input path is configured to receive a portion of solute, the mixing ring is structurally configured to lead the portion of solvent and the portion of solute to the mixing path in a downstream direction that is opposite an upstream direction, and the mixing ring further comprises a diffuser mostly placed in an internal area of the mixing path, the diffuser is configured to lead the portion of solvent towards the portion of solute, wherein the solute input path comprises a neck including a projection ramp configured to lead the portion of solute toward the diffuser, the projection ramp establishing an acute neck angle defined between the projection ramp and an internal wall of the mixing ring, wherein the solvent input path is configured as a solvent input zone associated to a choke zone, the choke zone disposed between the solvent input zone and the mixing path, wherein a first border between the solvent input zone and the choke zone establishes a first diameter and a second border between the choke zone and the mixing path establishes a second diameter which is smaller than the first diameter, the internal diameter of the choke zone including a first portion that is gradually decreasing from the first diameter to the second diameter until a point located upstream of the second border and including a second constant diameter portion that extends downstream toward the mixing path, wherein the projection ramp is formed on an outer surface of the choke zone that extends around the second portion of the internal diameter of the choke zone such that the projection ramp establishes the second border between the choke zone and the mixing path, the choke zone extending from the second border in the upstream direction and the mixing path extending from the second border in the downstream direction.

21. The mixing ring according to claim 20, wherein the value of the second diameter is between 50% and 65% of the value of the first diameter, further, a length of the mixing path is between 1.5 and 3.0 times the value of the first diameter.

22. The mixing ring according to claim 21, wherein the solute input path comprises a solute input zone and a solute chamber, the solute input zone establishes a third diameter and the solute chamber establishes a fourth diameter which is greater than the third diameter, the third diameter being equal to the second diameter of the mixing ring.

23. The mixing ring according to claim 22, wherein the solute chamber establishes a first width, assuming a value in the following range: $C/10 \leq E \leq C/3$, wherein E represents the first width and C represents the third diameter.

24. The mixing ring according to claim 23, wherein the solute input path further comprises the solute neck associated to the solute chamber, the solute neck establishing a second width.

25. The mixing ring according to claim 24, wherein the diffuser is a symmetric structure wherein the symmetric axis is the longitudinal axis of the mixing ring, the diffuser further comprises a first convex arc and a second convex arc oppositely displaced in relation to one another and connected by straight segments.

26. The mixing ring according to claim 25, wherein the projection ramp is configured to lead the portion of solute toward the straight segments of the diffuser.

27. The mixing ring according to claim 26, wherein vertices of respectively the first and second convex arcs are disposed in the longitudinal axis of the mixing ring.

28. The mixing ring according to claim 27, wherein the distance between the vertices is between 1.3 and 1.6 times greater the value of the first diameter and the diffuser width is between 23% and 26% the value of the first diameter.

29. The mixing ring according to claim 28, wherein the convex arcs respectively establish a first aperture angle and a second aperture angle, wherein the value of the first aperture angle is at least twice the value of the second aperture angle.

30. The mixing ring according to claim 29, wherein the choke zone defines a choke angle in the range from 15° to 30°.

31. The mixing ring according to claim 30, wherein the solvent input path receives the portion of solvent from a solvent tank and the solute input path receives the portion of solute from a solute tank.

32. A mixing ring for dissolving a portion of solute in a portion of solvent the mixing ring comprising:

a solvent input path and a solute input path fluidly associated to a mixing path, wherein, the solvent input path is configured to receive a portion of solvent and the solute input path is configured to receive a portion of solute, the mixing ring is structurally configured to lead the portion of solvent and the portion of solute to the mixing path in a downstream direction that is opposite an upstream direction, and, the mixing ring further comprises a choke zone structurally configured to lead the portion of solvent towards the portion of solute, wherein a neck of the solute input path comprises a projection ramp configured to lead the portion of solute toward the mixing path, the projection ramp establishing an acute neck angle defined between the projection ramp and an internal wall of the mixing ring, wherein the solvent input path comprises a solvent input zone associated to the choke zone, the choke zone disposed between the solvent input zone and the mixing path, wherein a first border between the solvent input zone and the choke zone establishes a first diameter and a second border between the choke zone and the mixing path establishes a second diameter which is smaller than the first diameter, the internal diameter of the choke zone including a first portion that is gradually decreasing from the first diameter to the second diameter until a point located upstream of the second border and including a second portion not of decreasing diameter that extends in the downstream direction from the second diameter toward the mixing path, wherein the projection ramp is formed on an outer surface of the choke zone that extends around the extending second portion of the internal diameter of the choke zone such that the projection ramp establishes the second border between the choke zone and the mixing path, the choke zone extending from the second border in the upstream direction and the mixing path extending from the second border in the downstream direction.

33. The mixing ring according to claim 32, wherein the choke zone defines a choke angle in the range from 15° to 30°.

34. The mixing ring according to claim 33, wherein the solute input path comprises a solute input zone and a solute chamber, the solute input zone establishes a third diameter and the solute chamber establishes a fourth diameter which is greater than the third diameter.

35. The mixing ring according to claim 34, wherein the solute chamber establishes a first width, assuming a value in the following range: $C/10 \leq E \leq C/3$ wherein E represents the first width and C represents the third diameter, and the solute input path further comprises the solute neck associated to the solute chamber, the solute neck establishing a second width and the projection ramp, the projection ramp configured to lead the portion of solute toward the mixing path.

36. A mixing ring for dissolving a solute in a solvent, the mixing ring being placed along pipes where a solute stream and a solvent stream are to be mixed and comprising:

a solvent input path configured as a solvent input zone associated to a choke zone, the choke zone disposed between the solvent input zone and a mixing path, wherein a first border between the solvent input zone and the choke zone establishes a first diameter and a second border between the choke zone and the mixing path establishes a second diameter which is smaller than the first diameter, the internal diameter of the choke zone including a first portion that is gradually decreasing from the first diameter to the second diameter until a point located upstream of the second border and including a second portion that does not decrease in diameter and that extends in the downstream direction from the second diameter toward the mixing path, a solute input path comprising a solute neck and a projection ramp configured to lead the portion of solute toward the mixing path, the projection ramp establishing an acute neck angle defined between itself and an internal wall of the mixing ring, and the solvent input path being placed upstream of the solute neck, both the solvent input path and the solute input path being fluidly connected to each other and leading to the mixing path, the mixing path being placed downstream, the solvent input path being provided with the choke zone, the solute input path being fluidly connected to the mixing path by the solute neck leading the solute towards the stream of solvent exiting the choke zone such that solute stream and solvent stream substantially orthogonally collide with each other, wherein the projection ramp is formed on an outer surface of the choke zone that extends around the extending second portion of the internal diameter of the choke zone such that the projection ramp establishes the second border between the choke zone and the mixing path, the choke zone extending from the second border in the upstream direction and the mixing path extending from the second border in the downstream direction.

37. The mixing ring for dissolving a solute in a solvent according to claim 36, wherein a diffuser is placed downstream from the choke zone.

* * * * *